US009776759B1

(12) United States Patent
Learn

(10) Patent No.: US 9,776,759 B1
(45) Date of Patent: Oct. 3, 2017

(54) DUAL-COMPARTMENT CONTAINER

(71) Applicant: PACTIV LLC, Lake Forest, IL (US)

(72) Inventor: Angela E. Learn, Gilbertsville, PA (US)

(73) Assignee: PACTIV LLC, Lake Forest, IL (US)

( * ) Notice: Subject to any disclaimer, the term of this patent is extended or adjusted under 35 U.S.C. 154(b) by 0 days.

(21) Appl. No.: 15/211,592

(22) Filed: Jul. 15, 2016

(51) Int. Cl.

| | |
|---|---|
| ***B65D 5/4805*** | (2006.01) |
| ***B65D 5/48*** | (2006.01) |
| ***B65D 5/00*** | (2006.01) |
| ***B65D 5/42*** | (2006.01) |
| ***B65D 5/66*** | (2006.01) |

(52) U.S. Cl.
CPC ..... *B65D 5/48016* (2013.01); *B65D 5/0085* (2013.01); *B65D 5/4266* (2013.01); *B65D 5/6608* (2013.01)

(58) Field of Classification Search
CPC B65D 5/48016; B65D 5/4266; B65D 5/6608; B65D 5/0085; B65D 5/6626; B65D 5/48002
USPC ..... 229/114, 120.04, 148, 904
See application file for complete search history.

(56) References Cited

U.S. PATENT DOCUMENTS 4,360,147 A * 11/1982 Brauner ..... B65D 5/667 229/146
4,431,128 A * 2/1984 Dirico ..... B65D 5/48002 229/120.03
4,694,987 A * 9/1987 Forbes, Jr. ..... B65D 5/48002 229/114
4,792,085 A * 12/1988 Waring, III ..... B65D 5/6626 229/114
5,332,147 A * 7/1994 Sorenson ..... B65D 5/6626 229/114
5,388,758 A * 2/1995 Scovell ..... B65D 5/4266 229/114
5,520,324 A * 5/1996 Cai ..... B65D 5/6626 229/114
5,575,420 A * 11/1996 Whitnell ..... B65D 5/6626 229/104
5,890,648 A * 4/1999 Cai ..... B65D 5/48018 229/120.05
6,349,875 B1 * 2/2002 Whitnell ..... B65D 5/667 229/114

(Continued)

*Primary Examiner* — Christopher Demeree
*Assistant Examiner* — Phillip Schmidt
(74) *Attorney, Agent, or Firm* — Baker Botts L.L.P.

(57) ABSTRACT

Dual-compartment food container is provided having an base portion including a base panel having first and second compartments defined therein and a cover portion including a cover panel joined by a common hinge portion. The cover portion is movable relative the base portion about the hinge portion from a substantially 180-degree open position to a closed position, wherein in the closed position, the cover portion is disposed over the first compartment with the second compartment extending beyond the cover portion. Each of the base portion and cover portion include at least one interlocking tab to releasably latch the base portion and cover portion. An engagement feature of the interlocking tabs can also provide a tactile indication to a user that the cover portion is secured in the closed position. A unitary blank for forming the dual-compartment food container from a sheet of blank material is also provided.

31 Claims, 8 Drawing Sheets

(56) References Cited

U.S. PATENT DOCUMENTS 8,733,722 B2 * 5/2014 Hung ..... F16M 13/02
248/123.11

* cited by examiner

DUAL-COMPARTMENT CONTAINER

BACKGROUND

Field of the Disclosed Subject Matter

The disclosed subject matter relates to a food container for packaging and serving of various combinations of food items, such as hamburgers and french fries, or other such combinations.

Description of Related Art

Many types of food items can be prepared, packaged, and sold by restaurants such as, for example, fast food restaurants, and takeout food vendors. Individual containers can be adapted for particular food items. Such containers generally are configured for a single food item, and often do not allow for both portability to carry the food item and stability for dining from the container.

Additionally, the efficiency in which multiple food items can be packaged can also be improved. For example, packaging multiple food items often involves handling of separate containers. The main food item, such as a hamburger, sandwich, or other food item, typically is sold with a side food item, such as french fries or onion rings, which is served to the consumer in a separate container. Such separate containers can add additional inefficiencies in packaging fast food meals and can involve additional expenses for businesses and restaurants. Similarly, containers for packaging multiple food items generally require extra handling for stacking containers and serving food items.

It is therefore desirable to provide a dual-compartment container, capable of easy stacking, having a hinged cover that can be opened to a substantially 180-degree position. It can also be desirable for the cover and base portions to include an engagement feature to secure the cover portion to the base portion in the closed position. Such an engagement feature can also provide a tactile indication to the user or server that the cover portion is secured in the closed position.

Additionally, it is desirable to provide a single folded blank for forming such containers, which can reduce manufacturing complexity, and reduce the number of pieces and costs associated with manufacture of disposable containers.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter provides a dual-compartment food container, as well as a unitary blank for forming the dual-compartment food container.

As embodied herein, the dual-compartment food container of the present disclosed subject matter includes a base portion having first and second compartment areas defined therein. The base portion includes a base panel defining a bottom of the first and second compartment areas. First and second base end walls each extend from the base panel to a base rim. The first base end wall has a first base end wall dimension between the base panel and the base rim, and the second base end wall has a second base end wall dimension between the base panel and base rim. The first base end wall dimension is greater than the second base end wall dimension. The base portion also includes first and second base side walls each extending from the base panel to the base rim and defining opposing base sides of the base portion. At least one of the first and second base side walls includes an interlocking base tab.

Additionally, and further to the above, the dual-compartment food container of the present disclosed subject matter includes a cover portion hingedly movable relative the base portion between an open position and a closed position. In the closed position, the cover portion is disposed over the first compartment area of the base portion with the second compartment area of the base portion extending beyond the cover portion. The cover portion includes a cover panel defining a top of the cover portion. First and second cover end walls each extend from the cover panel to a cover rim. The first cover end wall has a first cover end wall dimension between the cover panel and the cover rim, and the second cover end wall has a second cover end wall dimension between the cover panel and cover rim. The first cover end wall dimension is greater than the second cover end wall dimension. The cover portion also includes first and second cover side walls each extending from the cover panel to the cover rim and defining opposing cover sides of the cover portion. At least one of the first and second cover side walls includes an interlocking cover tab configured to engage the at least one corresponding interlocking base tab when the cover portion is in the closed position.

Additionally, and further to the above, the dual-compartment food container of the disclosed subject matter includes a hinge portion disposed between the base portion and cover portion. The hinge portion includes first and second outer hinge fold lines each extending to first and second perpendicular score lines, respectively, and first and second inner hinge fold lines parallel with and offset from the first and second outer hinge fold lines. The first and second inner hinge fold lines extending between the first and second perpendicular score lines.

Additionally or alternatively, and as embodied herein, the dual-compartment food container can include first and second base side walls each having a base sidewall dimension between the base panel and the base rim, and the base sidewall dimension can be less than the first base end wall dimension. The first base end wall can extend from the base panel to a radiused outer end edge of the base rim. The first base end wall can further include opposing joining flaps extending outwardly from opposing outer edges of the first base end wall. Each of the opposing joining flaps can be configured to join to the first and second base side walls. The interlocking base tab can have a curved projection extending to a substantially linear edge portion of the at least one of the first or second base side wall. The second base end wall can further include opposing joining tabs extending from opposing outer edges of the second base end wall. The opposing joining tabs can be configured to join to the first and second base side walls.

Additionally or alternatively, and as embodied herein, the dual-compartment food container can include a hinge portion having a pair of inner score lines extending between the first and second inner hinge fold lines. Each of the inner score lines can be substantially collinear with the first and second inner hinge fold lines. The first and second perpendicular score lines can extend beyond the first and second outer hinge fold lines.

Additionally or alternatively, and as embodied herein, the dual-compartment food container can include first and second cover side walls each having a cover sidewall dimension between the cover panel and the cover rim. The cover side wall dimension can be less than the first cover end wall dimension. The cover side wall dimension can be greater than the base side wall dimension. The interlocking cover tab can have a curved projection having a curvature substantially equal to a curvature of a curved projection of the interlocking base tab. The first cover end wall dimension can be greater than the second cover end wall, and the first cover end wall can be configured to separate the first and second compartment areas of the base portion when the cover portion is in the closed position. The first and second cover side walls can each further include a joining tab extending therefrom and configured to join to the cover end wall.

The dual-compartment container can include any or all of the features described herein.

According to another aspect of the disclosed subject matter, and further to the above, a unitary blank for forming a dual-compartment container is provided. As embodied herein, the unitary blank of the present disclosed subject matter includes a base portion having a base panel with opposing first and second base side fold lines and opposing first and second base end fold lines. The base panel has a base panel length between the first and second base end fold lines. A first base end wall extends from the first base end fold line to a first base end edge, and the first base end wall has a first base end wall dimension between the first base end fold line and the first base end edge. A second base end wall extends from the second base end fold line to a second base end edge, and the second base end wall has a second base end wall dimension between the second base end fold line and the second base end edge. The first and second base side walls extend from the first and second base side fold lines, respectively, to a first and second base side edge. The first and second base side walls have a base side wall dimension between the first and second base side fold lines and the first and second base side edge. At least one of the base side edges has an interlocking base tab.

Additionally, and further to the above, the unitary blank of the disclosed subject matter includes a cover panel portion having a cover panel with opposing first and second cover side fold lines and first and second cover end fold lines. The cover panel has a cover panel length between the first and second cover end fold lines. A first cover end wall extends from the first cover end fold line to a first cover end edge, and the first cover end wall has a first cover end wall dimension between the first cover end fold line and the first cover end edge. A second cover end wall extends from the second cover end fold line to a second cover end edge, and the second cover end wall has a second cover end wall dimension between the second cover end fold line and the second cover end edge. The first and second cover side walls extend from the first and second cover side fold lines, respectively, to a cover side edge. The first and second cover side walls have a cover side wall dimension between the first and second cover side fold lines and the first and second cover side edge. At least one of the cover side edges has a an interlocking cover tab substantially aligned and configured to engage a corresponding interlocking base tab.

Additionally, and further to the above, the unitary blank of the disclosed subject matter includes a hinge portion disposed between the base portion and the cover portion. The hinge portion includes first and second outer hinge fold lines each extending to first and second perpendicular score lines, respectively, and first and second inner hinge fold lines parallel with and offset from the first and second outer hinge fold lines. The first and second inner hinge fold lines extend between the first and second perpendicular score lines.

Additionally, or alternatively, and as embodied herein, the unitary blank can include a base sidewall dimension that is less than the first base end wall dimension. The first base end wall can extend from the base panel to a radiused outer end edge of the base rim. The first base end wall dimension can be greater than the second base end wall dimension. The first base end wall can further include opposing joining flaps extending outwardly from opposing outer base edge fold lines of the first base end wall. The opposing joining flaps can be configured to join to the first and second base side walls, respectively, when the first base end wall is folded about the first base end fold line. The at least one interlocking base tab can have a curved projection extending to a substantially linear edge portion of the at least one of the first or second base side wall. The second base end wall can further include opposing joining tabs extending from opposing outer base edge fold lines of the second base end wall. The opposing joining tabs can be configured to join to the first and second base side walls, respectively, when the second base end wall is folded about the second base end fold line.

Additionally, or alternatively, and further to the above, the first cover end wall dimension can be approximately equal to the second base end wall dimension. The cover top panel length can be less than the bottom panel length. The first cover end wall can further include opposing cover joining tabs extending outwardly from opposing outer cover edge fold lines of the first cover end wall. The cover joining tabs can be configured to join to the first and second cover side walls, respectively, when the first cover end wall is folded about the first cover end fold line. The at least one interlocking cover tab can have a curved projection having a curvature substantially equal to a curvature of a curved projection of the interlocking base tab. The first and second cover side walls can each further include a joining tab extending from an outer end fold line. The joining tab can be configured to join to the second cover end wall when the second cover end wall is folded about the second cover end fold line. The first cover end wall can have a greatest dimension substantially equal to the second cover end wall dimension and the second base end wall dimension combined. The first cover end edge can have a concave shape relative the cover panel.

Additionally, or alternatively, and further to the above, the hinge portion can further include a pair of inner score lines extending between the first and second inner hinge fold lines. Each of the inner score lines can be substantially collinear with the first and second inner hinge fold lines. The first and second perpendicular score lines can extend beyond the first and second outer hinge fold lines The unitary blank can include any or all of the features described herein.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the disclosed subject matter. Together with the description, the drawings serve to explain the principles of the disclosed subject matter.

DETAILED DESCRIPTION

Figure 1:
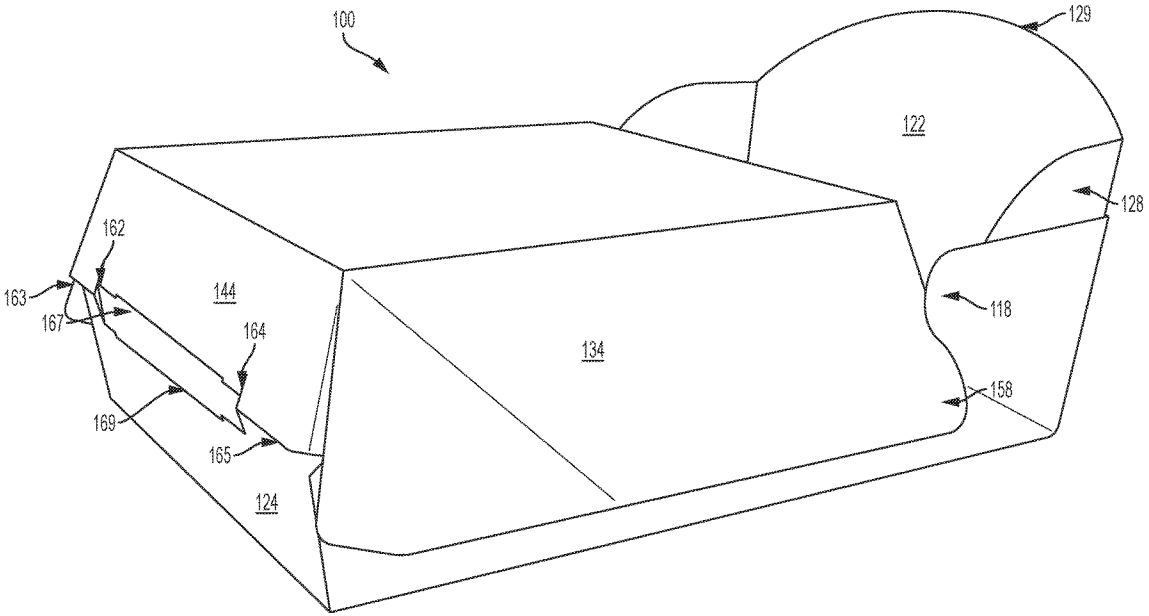
FIG. 1 is a front, right perspective view of an exemplary embodiment of a dual-compartment container in accordance with the disclosed subject matter, shown with the cover in a closed position.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein may be used for transport of food items and other perishable and non-perishable products. The disclosed subject matter is particularly suited for packaging and serving of food items or combinations of food items, wherein the container can convert between a closed position, in which the contents of the container are enclosed, and an open position, in which the container includes a dual-compartment base portion for receiving and storing food items. Also, the container includes a hinge portion that can allow a cover portion to move into a substantially 180-degree open position relative the base portion.

Particularly, the disclosed subject matter is directed to a container for holding food items, wherein the container has a base portion defining first and second communicating compartment areas for holding food items and a cover portion moveable between open and closed positions. With the cover portion disposed over the first compartment area of the base portion in the closed position, the container can serve as a secure and reliable packaging carton. The second compartment area can serve to hold food items, such as french fries, or other side food items, in an upright position. Additionally, the container of the present disclosed subject matter can be stacked in a nested fashion when in the open position for easy serving and packaging of food items.

The accompanying figures, where like reference numerals refer to identical or functionally similar elements throughout separate views, serve to further illustrate various embodiments and to explain various principles and advantages all in accordance with the disclosed subject matter. For purpose of explanation and illustration, and not limitation, exemplary embodiments of the container, and a blank for forming the container, in accordance with the disclosed subject matter are shown in FIGS. 1-8. The container is suitable for use with a wide variety of hot and cold food items and combinations of food items, such as hamburgers, sandwiches, french fries, onion rings, and the like. The dual-compartment container disclosed herein is particularly suitable and beneficial for use with hot, prepared food items that are commonly served in pairs, such as hamburgers and french fries.

For purpose of illustration, and not limitation, reference will be made to a container, or dual-compartment container, intended to contain food items. As used herein, the terms "front," "end," "side," "top," and "bottom" are used for the purpose of illustration only, and not limitation. That is, it is recognizable that the terms "front," "end," "side," "top," and "bottom" are interchangeable and are merely used herein as a point of reference. Additionally, as used herein, the term "score line" includes a line incised or otherwise cut through the surface of the container or the blank used to form the container of the disclosed subject matter, and the term "fold line" includes a line of indentation or bending formed in the surface of the container or the blank used to form the container of the disclosed subject matter.

As embodied herein, a dual-compartment food container of the disclosed subject matter includes a base portion having first and second compartment areas defined therein.

The base portion includes a base panel defining a bottom of the first and second compartment areas. First and second base end walls each extend from the base panel to a base rim of the base portion. The first base end wall has a first base end wall dimension between the base panel and the base rim, and the second base end wall has a second base end wall dimension between the base panel and base rim. The first base end wall dimension is greater than the second base end wall dimension. The base portion also includes first and second base side walls each extending from the base panel to the base rim and defining opposing base sides of the base portion. At least one of the first and second base side walls includes an interlocking base tab. Additionally, the dual-compartment container of the present disclosed subject matter includes a cover portion hingedly movable relative the base portion between an open position and a closed position. In the closed position, the cover portion is disposed over the first compartment area of the base portion with the second compartment area of the base portion extending beyond the cover portion. The cover portion includes a cover panel defining a top of the cover portion. First and second cover end walls each extend from the cover panel to a cover rim of the cover portion. The first cover end wall has a first cover end wall dimension between the cover panel and the cover rim, and the second cover end wall has a second cover end wall dimension between the cover panel and cover rim. The first cover end wall dimension is greater than the second cover end wall dimension. The cover portion also includes first and second cover side walls each extending from the cover panel to the cover rim and defining opposing cover sides of the cover portion. At least one of the first and second cover side walls includes an interlocking cover tab configured to engage the at least one corresponding interlocking base tab when the cover portion is in the closed position.

Additionally, the dual-compartment container of the present disclosed subject matter includes a hinge portion disposed between the base portion and cover portion. The hinge portion includes first and second outer hinge fold lines each extending to first and second perpendicular score lines, respectively, and first and second inner hinge fold lines parallel with and offset from the first and second outer hinge fold lines. The first and second inner hinge fold lines extending between the first and second perpendicular score lines.

For the purpose of illustration, and not limitation, reference is made to the exemplary dual-compartment container 100 shown in exemplary FIGS. 1-7. Additionally, for purpose of understanding, reference is made in conjunction to the blank 200 of FIG. 8, which forms the container 100 of exemplary FIGS. 1-7.

Figure 8:
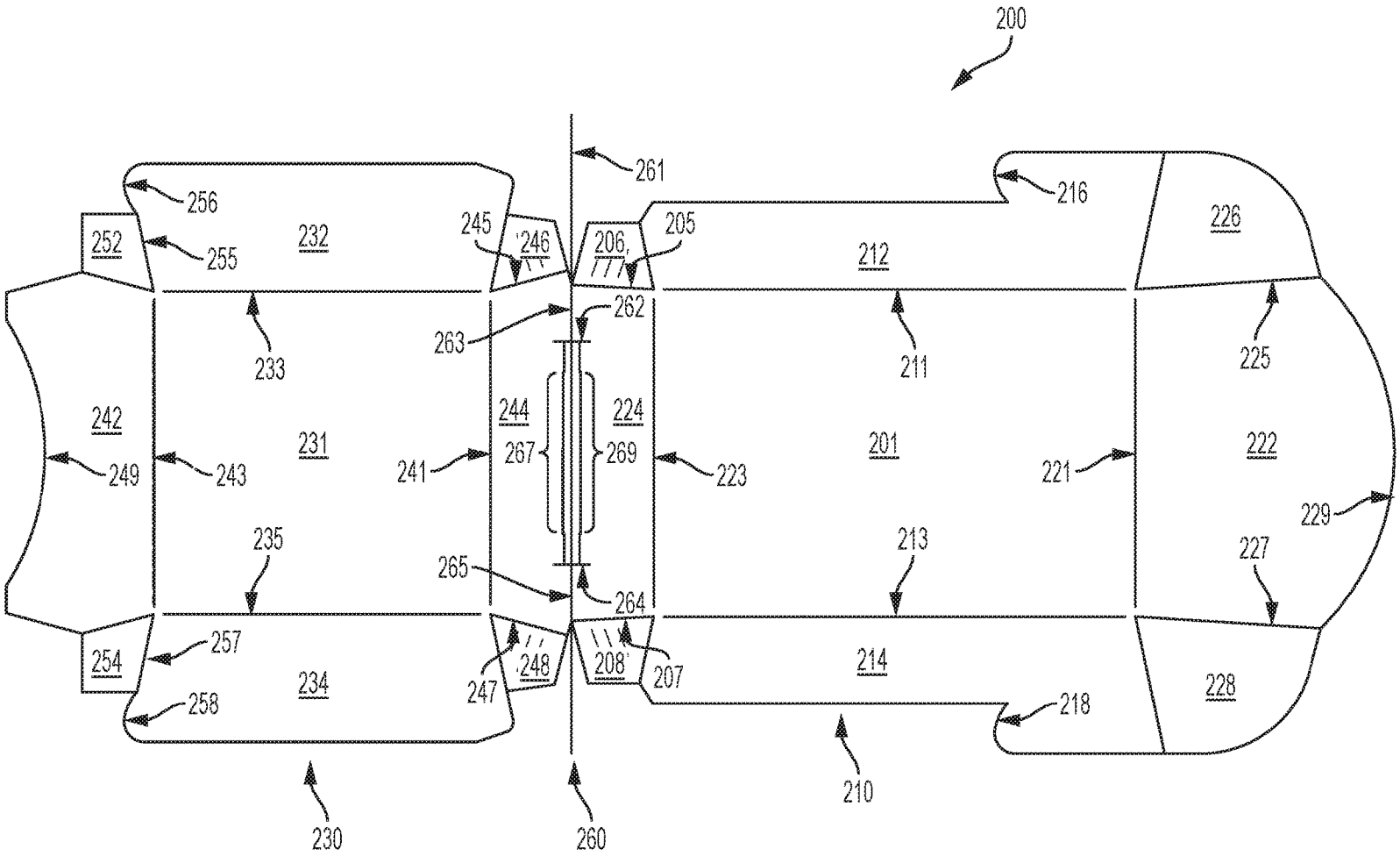
FIG. 8 is a plan view of an exemplary embodiment of a unitary blank for forming the dual-compartment container of FIG. 1 in accordance with the disclosed subject matter.

As shown in FIGS. 1-7, the dual-compartment container 100 is generally is folded from a unitary blank of paperboard material, such as the blank 200 of FIG. 8. Additionally, or alternatively the unitary blank can be made of suitable alternative materials, such as pulp board, paper, micro-flute corrugated material, or thermoplastic materials. The unitary blank of the disclosed subject matter can be retained the three-dimensional configuration, such as, for example and without limitation, by adhesive bonding. Additionally, or alternatively, the unitary blank can be retained in the three-dimensional configuration by tucking projecting portions of blank 200 into slits provided and designed to clasp or otherwise engage such projecting portions. Other suitable additional or alternative retention means are within the scope of the disclosed subject matter.

Figure 5A:
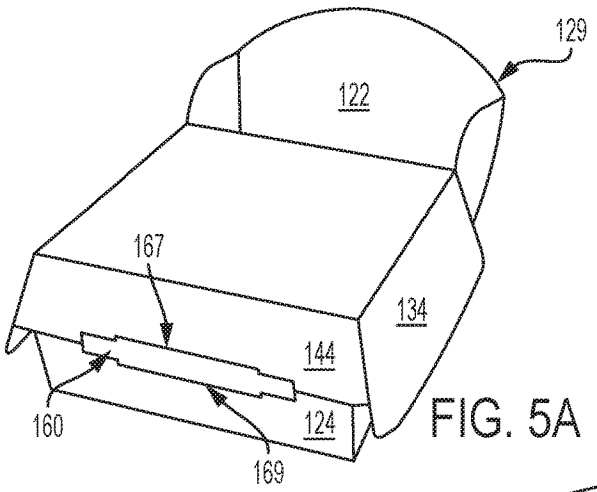
FIG. 5A is a front perspective view of the dual-compartment container of FIG. 1, shown with the cover in the closed position.
Figure 5B:
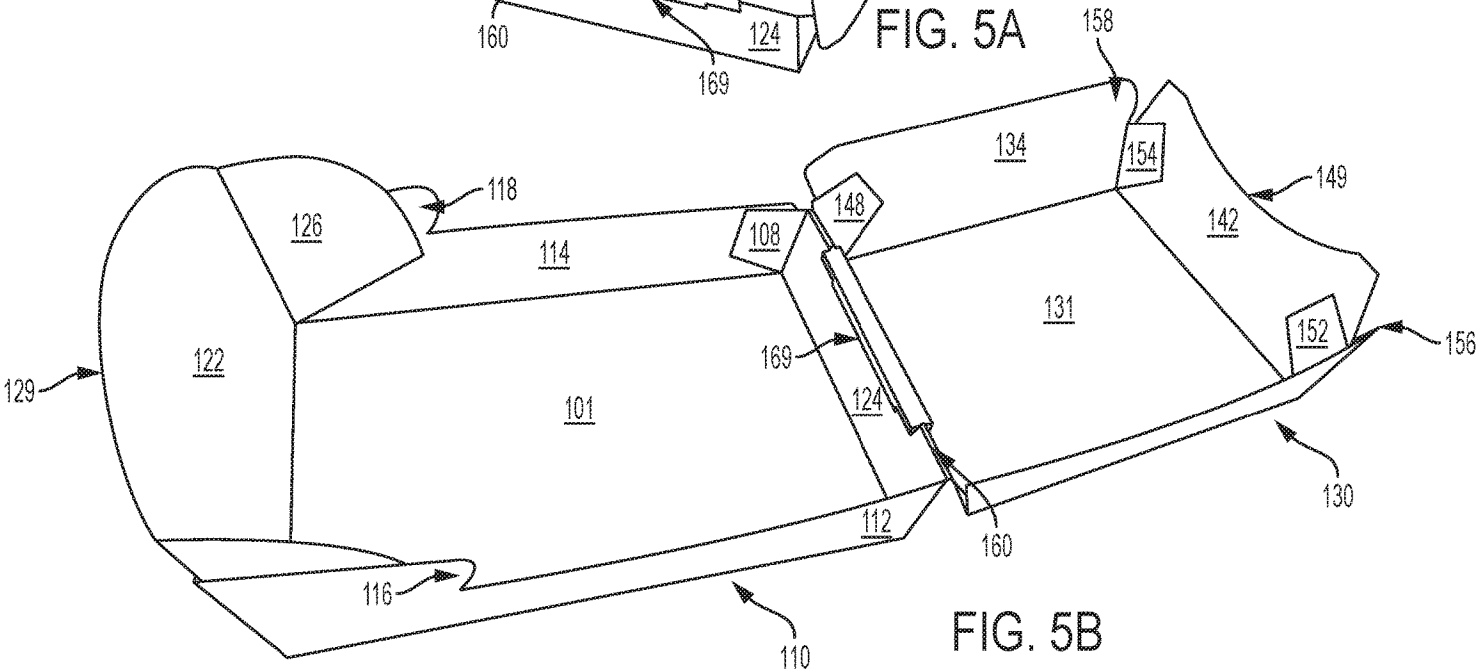
FIG. 5B is a left perspective view of the dual-compartment container of FIG. 1, shown with the cover in the open position.

As shown in exemplary FIG. 5B, the container 100 generally includes a base portion 110 and a cover portion 130 with a hinge portion 160 disposed between the base portion 110 and the cover portion 130. The base portion 110 generally includes a base panel 101 defining the bottom of first and second compartment areas (102, 103) (not shown in FIG. 5) of the base portion 110 for holding food items therein. The base panel 101 can have a base panel length extending between first and second base end walls. For purpose of illustration and not limitation, the base panel length can be within a range of 4 inches to 6 inches, and as embodied herein, the base panel lengths can be 6 inches. The base portion 110 generally further includes opposing first and second end walls (122, 124), each integral with the base panel 101, and each extending a first and second base end wall dimension, respectively, from the base panel to a base rim to define an interior of the base portion 110 when formed into the three-dimensional container 100. For example and without limitation, the first base end wall 122 can have a greatest first base end wall dimension extending from the base panel to the base rim 129. For purpose of illustration and not limitation, the first base end wall dimension can be within a range of 1½ inches to 5 inches, and as embodied herein, can be 2½ inches. Similarly, for purpose of illustration, and not limitation, the second base end wall 124, extending from the base panel, can have a second base end wall dimension within a range ½ inch to 2 inches, and as embodied herein, can be 1 inch.

Additionally, base portion 110 generally includes opposing first and second base side walls (112, 114), each integral with the base panel 101, and each extending a base side wall dimension from the base panel to the base rim. As embodied herein, and as illustrated for example in FIGS. 1, 5A-5B, and 6, the base side walls (112, 114) can have a generally trapezoidal shape and form angles outwardly from base panel 101, which can aid in the stabilization of the dual-compartment container 100, provide easy access to food items served and contained therein and allow for nesting a stack of containers 100. For purpose of illustration, and not limitation, the base side walls (112, 114), extending from the base panel, can have a base sidewall dimension within a range of 13/16 inch to 2 1/16 inches, and as embodied herein, can be 1 1/16 inches.

Figure 2:
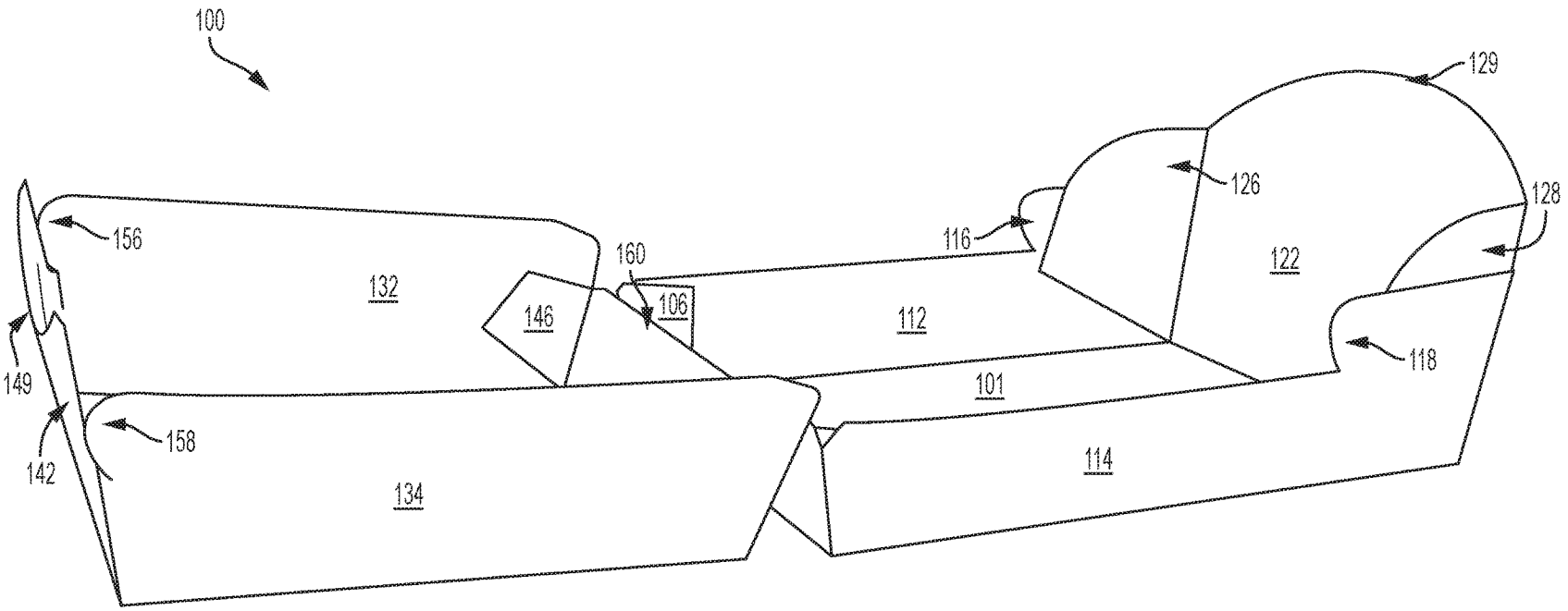
FIG. 2 is a right perspective view of the dual-compartment container of FIG. 1, shown with the cover in an open position.
Figure 3A:
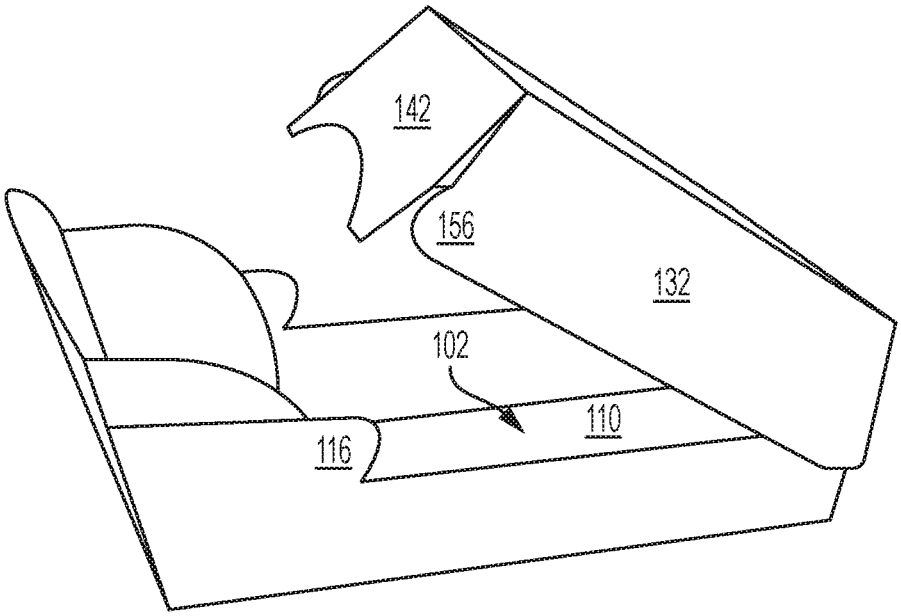
FIG. 3A is a left perspective view of the dual-compartment container of FIG. 1, shown with the cover in a partially open position.
Figure 3B:
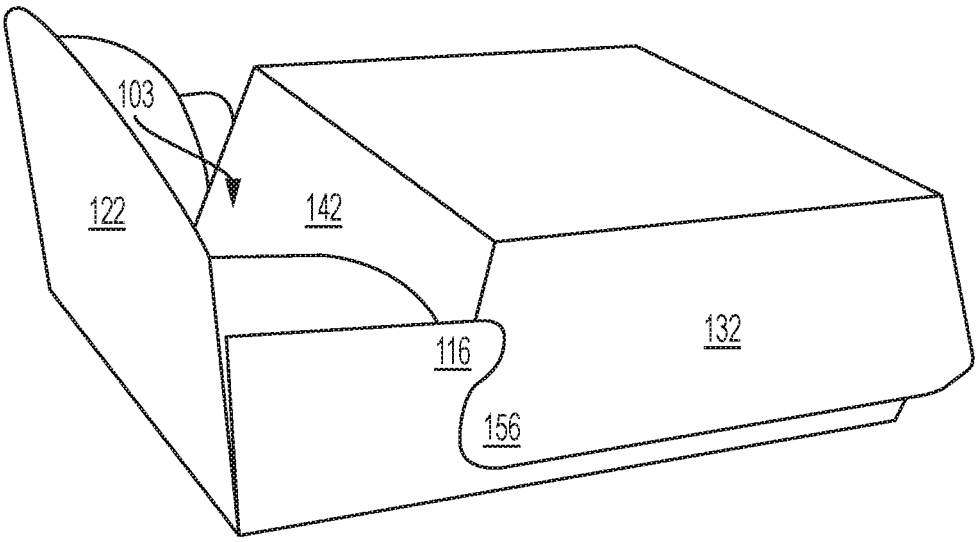
FIG. 3B is a rear, left perspective view of the dual-compartment container of FIG. 1, shown with the cover in the closed position.
Figure 4A:
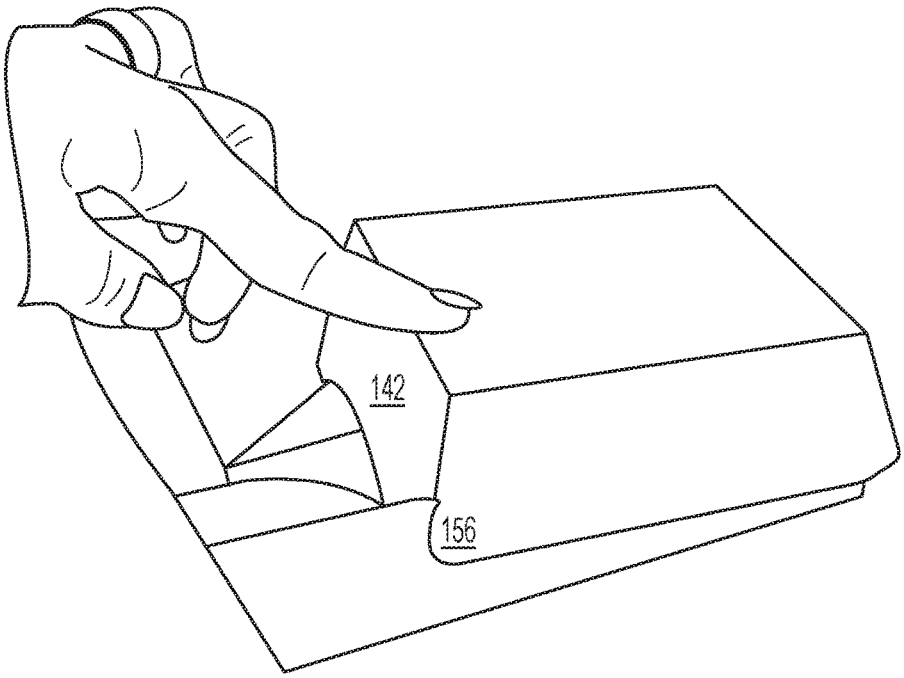
FIG. 4A is a left perspective view of the dual-compartment container of FIG. 1, shown with the cover in a partially closed position.
Figure 4B:
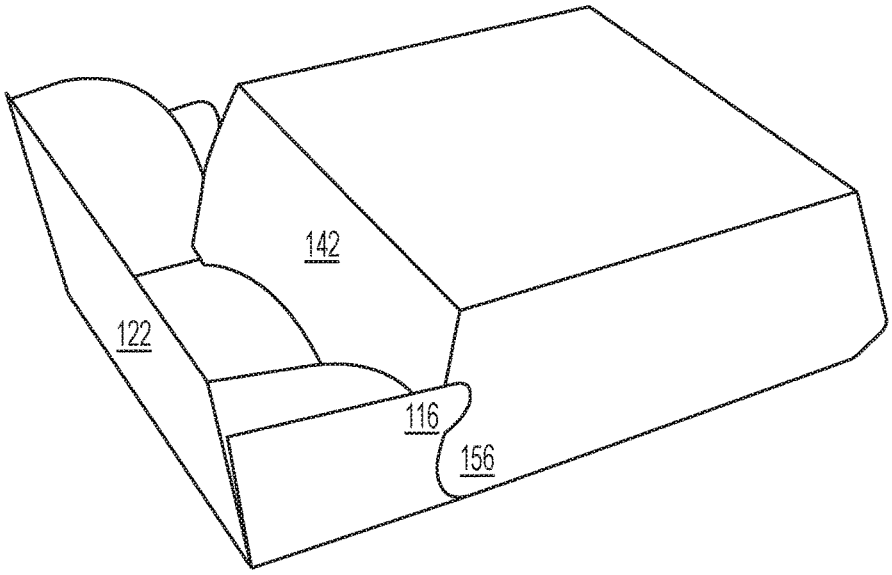
FIG. 4B is a rear, left perspective view of the dual-compartment container of FIG. 1, shown with the cover in the closed position.

As shown for example in FIGS. 3A-3B, the first compartment area 102 of the base portion 110 can be used for storing or packaging a food item, such as a primary or main food item, including for example, a hamburger, and is proximate to the second base end wall 124. The second compartment area 103 of the base portion 110 can be used for storing or packaging a secondary food item, such as french fries, and is proximate to the first base end wall 122. The first base end wall 122 can additionally extend from the base panel 101 a first base end wall dimension greater than the second base end wall dimension of the second base end wall from the base panel 124, as illustrated for example in FIG. 1. Additionally or alternatively, the first base end wall 122 can extend to an outer end edge of the base rim 129. The outer end edge of base rim 129 can have a radiused edge. The radiused edge of the outer end edge 129 can be bowed outward to define an convex arcuate shape of the base rim, as depicted by way of example in FIGS. 1-7.

As shown in exemplary FIGS. 1 and 5B, the first base end wall 122 can additionally, or alternatively, include opposing joining flaps (126, 128) extending outwardly from opposing outer edges of the first base end wall 122, and each joining flap (126, 128) can be configured to join to the first and second base side walls (112, 114). Additionally, or alternatively, the opposing joining flaps (126, 128) can extend outward from the first base end wall 122 at an angle from the base panel 101. Similarly, the second base end wall 124 can additionally, or alternatively, include opposing joining tabs (106, 108) extending outwardly from outer edges of the second base end wall 124. For example, and without limitation, the opposing joining flaps (126, 128) and opposing joining tabs (106, 108) of the base portion can join to the first and second base side walls by adhesive bonding. Additionally or alternatively, slits can be provided in the first and second base side walls (112, 114) to receive projecting flaps and/or tabs to retain the first and second base end walls (122, 124) to the first and second base side walls (112, 114) in the three-dimensional configuration. Additionally or alternatively, when joined to the opposing first and second base side walls (112, 114) by opposing joining flaps (126, 128), the first base end wall 122 can extend outward at an angle from the bottom panel 101.

Additionally, or alternatively, the first and second base side walls (112, 114) of the base portion 110 can extend from the base panel 101 the base side wall dimension. As previously described, the base side wall dimension of the first and second base side walls (112, 114) can be less than the first base end wall dimension. For example, and without limitation, the base side wall dimension can be approximately one-half the first base end wall dimension for a substantial portion of a length of the first and second base side walls (112, 114). At least one or both of the first and second base side walls (112, 114) can include at a projection defining an interlocking base tab (116, 118). Additionally or alternatively, the at least one interlocking base tab (116, 118) can have a curved edge extending to a substantially linear portion of the corresponding first or second base side wall. For purpose of illustration, and not limitation, the at least one interlocking base tab can have a curved edge with a radius of curvature within a range of 3/16 inch radius to 3/8 inch radius.

With reference to FIGS. 1-7, the cover portion 130 of the dual-compartment container 100 herein disclosed is formed from a cover panel 131, a pair of opposing first and second cover side walls (132, 134) extending a cover side wall dimension from the cover panel 131, and first and second cover end walls (142, 144) extending a first and second cover end wall dimension, respectively, to a cover rim. For purpose of illustration, and not limitation, the cover panel 131 can have a cover panel length within a range of 1 inch to 9½ inches, and as embodied herein, can be 4⅛ inches.

The first and second cover side walls (132, 134) can be joined to the second cover end wall 144, for example and without limitation, by adhesively bonding opposing joining tabs (146, 148), which extend outwardly therefrom. Additionally, or alternatively the second cover end wall can provide slits to receive joining tabs (146, 148) therein. The first cover end wall dimension can be greater than the second cover end wall dimension. Additionally, or alternatively, the first cover end wall dimension can be can be substantially equal to the second cover end wall dimension and the second base end wall dimension combined. Furthermore, the first cover end wall can extend to an outer end edge of the cover rim. Additionally or alternatively, the outer end edge of the cover rim 149 can have a concave shape relative the cover panel 131, as shown in FIG. 5B. For example and without limitation, the first cover end wall 142 can have a greatest first cover end wall dimension extending from the cover panel to the cover rim 149. For purpose of illustration and not limitation, the first cover end wall dimension can be within a range of 1⅜ inches to 3⅞ inches, and as embodied herein, can be 1⅞ inches. Similarly, for purpose of illustration, and not limitation, the second cover end wall dimension can be within a range of 1½ inches to 2 inches, and as embodied herein, can be 1 inch.

Additionally, cover portion 130 generally includes opposing first and second cover side walls (132, 134), each integral with the cover panel 131, and each extending a cover side wall dimension from the cover panel to the cover rim. For purpose of illustration, and not limitation, the cover side wall dimension can be within a range of 1¼ inches to 2¾ inches, and as embodied herein, can be 1½ inches. By way of example, and not limitation, at least one or both of the first and second cover side walls (132, 134) can include an interlocking cover tab (156, 158). As shown in FIGS. 3A-3B, the at least one interlocking cover tab (156, 158) of the first and second cover side walls (132, 134) is configured to engage the at least one corresponding interlocking base tab (116, 118) of the base portion 110 when the cover portion 130 is in the closed position over the first compartment area 102 of the base portion 110. Additionally or alternatively, the at least one interlocking cover tab (156, 158) of the first and second cover side walls (132, 134) can project outwardly relative the cover panel to a curved edge. The curved edge of the at least one interlocking cover tab (156, 158) can have a curvature substantially equal to a curvature of the at least one interlocking base tab (116, 118) of the first and second base side walls (112, 114). The first and second cover side walls (132, 134) can each further include a joining tab (152, 154) extending from an outer edge of the cover side walls (132, 134) proximate the first cover end wall 142. Additionally or alternatively, the joining tabs (152, 154) of the first and second cover side walls (132, 134) can be configured to join to the cover end wall 142 to thereby define an interior of the cover portion 130, for example, and without limitation, by adhesive bonding, or other suitable retention means For example, the joining tabs (152, 154) of the cover sides walls (132, 134) can be configured to join to an inner or an outer face of the first cover end wall 142. Additionally or alternatively, slits can be provided in the first cover end wall to receive projecting joining tabs (152, 154) therein.

Additionally, or alternatively, and as illustrated by way of example, and not limitation in FIGS. 2 and 3A-3B, the cover side walls (132, 134) can extend the cover side wall dimension, which can be greater than the base side wall dimension of the first and second base side walls (112, 114). As illustrated in exemplary FIGS. 1 and 3, the cover side walls (132, 134) can further extend outward from the cover panel 131 at an angle greater than that of the base side walls (112, 114) from the base panel 101 to enclose the first compartment 102 of the base portion 110 when the cover portion 130 is in the closed position such that the first and second cover side walls (132, 134) can be disposed outward from the first and second base side walls (112, 114). When in the closed position, as illustrated for example and without limitation in FIGS. 3B, 4B, and 6B-6C, the first cover end wall 142 of the cover portion 130 is configured to separate the first compartment area 102 from the second compartment area 103 of the base portion 110.

With continued reference to FIGS. 1-7, the hinge portion 160 of the dual-compartment container 100 of the disclosed subject matter is disposed between the base portion 110 and the cover portion 130. As embodied herein, the hinge portion includes first and second outer hinge fold lines (163, 165) each extending to first and second perpendicular score lines (162, 164), respectively. For purpose of illustration, and not limitation, the first and second outer hinge fold lines can have an outer hinge fold line dimension within a range of ⅝ inch to 1 inch, and as embodied herein, can be ⅝ inch. Similarly, for purpose of illustration, and not limitation, the first and second perpendicular score lines can have a perpendicular score line dimension of ⅛ inch, and can extend beyond the first and second outer hinge fold lines. The hinge portion 160 further includes first and second inner hinge fold lines parallel with and offset from the first and second outer hinge fold lines (163, 165). For purpose of illustration, and not limitation, the first and second inner hinge fold lines can be parallel with and offset 1/64 inch from the first and second outer hinge fold lines, and can each extend an exemplary inner hinge fold line dimension of ⅜ inch. The first and second inner hinge fold lines extend between the first and second perpendicular score lines (162, 164).

Figure 6A:
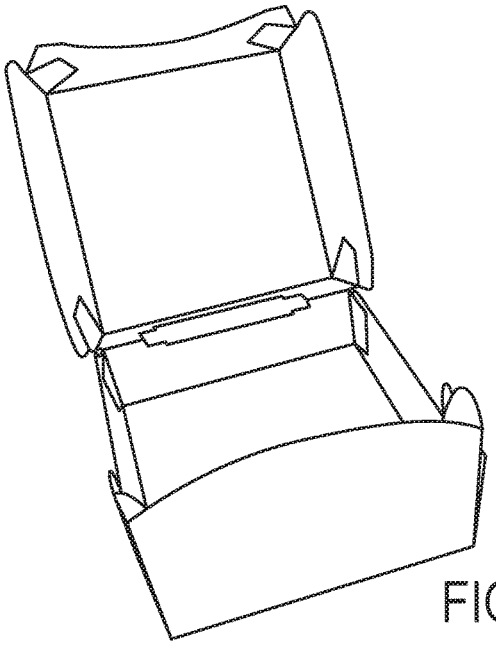
FIG. 6A is a rear perspective view of the container of FIG. 1, shown with the cover in the open position.
Figure 6B:
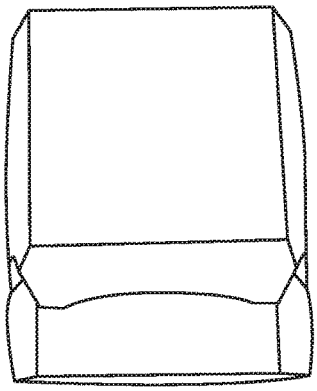
FIG. 6B is a top perspective view of the container of FIG. 1, shown with the cover in the closed position.
Figure 6C:
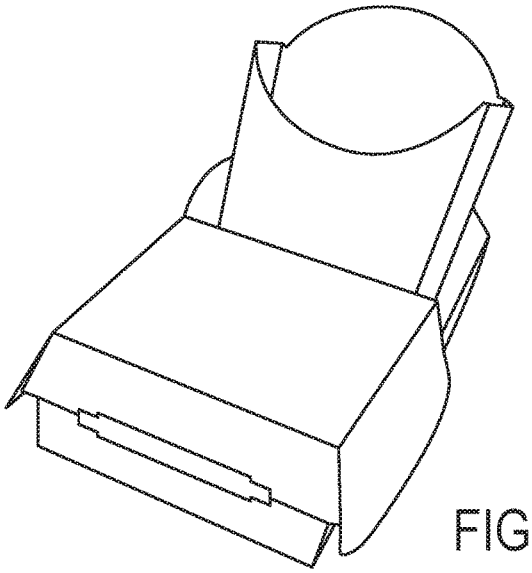
FIG. 6C is a front right perspective view of the container of FIG. 1, shown with the cover in the closed position and a secondary container in the second compartment.
Figure 7:
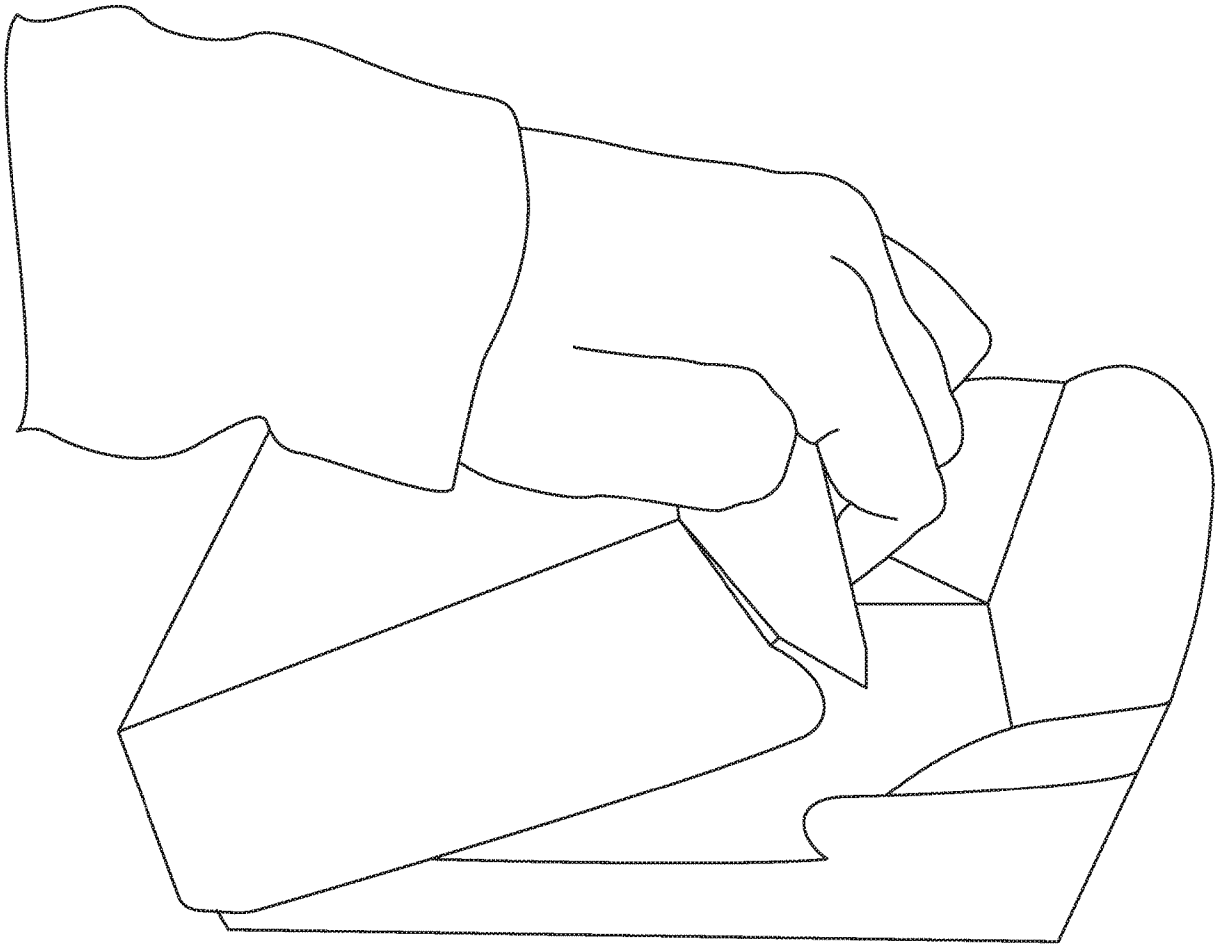
FIG. 7 is a right perspective view of the container of FIG. 1, shown with the cover in a partially open position.

As shown in exemplary FIGS. 1, 5A, and 6C, by way of example and not limitation, the hinge portion 160 can be disposed between the second base end wall 124 and the second cover end wall 144 of the dual-compartment container 100. Alternatively, the hinge portion 160 can be disposed between the first base side wall and the first cover side wall. Alternatively, the hinge portion 160 can be disposed between the second base side wall and the second cover side wall. The first and second outer hinge fold lines (163, 165) extending to perpendicular score lines (162, 164) facilitate the pivoting movement of the cover portion 130 relative the base portion 110 between the open and closed positions. For purpose of illustration, and not limitation, the perpendicular scores lines (162, 164) can have a perpendicular score line dimension of ⅛ inch cut through the first and second outer hinge fold lines and extending perpendicularly beyond the first and second inner fold lines, and through the surface of the container 100.

As embodied herein and illustrated by way of example, and not limitation, in FIGS. 1 and 5A, the hinge portion 160 can additionally or alternatively include a pair of inner score lines (167, 169) extending between the first and second perpendicular score lines (162, 164). The inner score lines (167, 169) are parallel and substantially collinear with the first and second inner hinge fold lines at a length less than a total length between the first and second perpendicular score lines (162, 164). As illustrated by way of example and not limitation in FIGS. 2 and 5A-5B, when the cover portion 130 of the dual-compartment container 100 is in the open position, the perpendicular score lines (162, 164) of the hinge portion 160 extend beyond the first and second outer hinge fold lines (163, 165). That is, the perpendicular score lines (162, 164) can extend above the first outer hinge 163 fold line and below the second outer hinge fold line 165. In this manner, the perpendicular score lines (162, 164) can be configured to allow the base panel 101 of the base portion 110 and the cover panel 131 of the cover portion 130 to open to substantially 180-degrees such that the cover panel 131 is substantially coplanar with the base panel 101, which can occur without binding or buckling of the hinge portion 160.

In operation, for purpose of illustration and not limitation, the base portion 110 of the dual-compartment container 100 can be used to contain pairs of food items, such as, for example, a hamburger and french fries, to provide a meal of two different items in a disposable container. For example and without limitation, the base portion 110 can be integral with the cover portion 130 along the second base end wall 124. Alternatively, the base portion 110 can be integral with the cover portion 130 along a first or second base side wall (112, 114).

The cover portion 130 is hingedly movable relative the base portion 110 between an open position and a closed position about a hinge portion 160, as illustrated by way of example in FIGS. 1-7. When the container is closed, as illustrated in FIG. 1, the cover portion 130 is disposed over the first compartment area 102 of the base portion 110. The first compartment area 102 can contain a main food item, such as a hamburger or sandwich, or other food item. The second compartment area 103 of the base portion 110 extends beyond the cover portion 130 when the dual-compartment container is closed. For example and without limitation, a side food item, such as french fries, onion rings or other side food item, can be stored in the second compartment area 103. Additionally or alternatively, the side food items can be contained within a secondary container, such as, for example and not limitation, a scoop, bag, or pouch disposed within the second compartment area 103. Additionally or alternatively, the side food item can be stored directly in the second compartment area 103. As illustrated in exemplary FIG. 6C, a scoop containing side food items can be stored in the second compartment area 103 and can be disposed upright against the first base end wall 122 to reduce spillage of the side food items. For example, a food preparer or server can prepare and/or serve a main food item and a side food item into the first and second compartment areas of the container, respectively, so as to provide a meal to a customer.

To move the dual-compartment container from the open position to the closed position, a user, such as a food preparer, server or customer, can pivot the cover portion 130 about the hinge portion 160 toward the base portion 110. When the cover portion 130 is moved over the first compartment area 102 of the base portion 110, the at least one interlocking cover tab (156, 158) of the at least one cover side wall (132, 134) can initially engage the at least one interlocking base tab (116, 118) of the at least one base side wall (112, 114). Further urging of the cover portion 130 toward the base portion 110 can generate a frictional force between the interlocking cover tabs and the interlocking base tabs, which can provide tactile feedback to the user, as shown by way of example and not limitation in FIG. 4A. The interlocking cover and base tabs can engage when the container is closed, such as in exemplary FIG. 4B. The user can sense a tactile indication that the corresponding interlocking tabs have engaged and interlocked.

Additionally or alternatively, and as illustrated in exemplary FIGS. 1-7, when the cover side walls (132, 134) and base side walls (112, 114) are each flared, respectively, at an angle from the cover panel 131 and the base panel 101, the engagement of the at least one interlocking cover tab (156, 158) with the at least one interlocking base tab (116, 118) can further provide an effective frictional retention of the cover portion 130 over the base portion 110 when the dual-compartment container 100 is closed. In such a configuration, the food items contained in the first compartment area 102 can be securely enclosed.

To move the dual-compartment container from the closed position to the open position, the user can pivot the cover portion 130 about the hinge portion 160 away from the base portion 110. For example and without limitation, a user can exert sufficient upward force on the cover portion 130 to overcome the frictional retention of the engaged interlocking cover and base tabs. Additionally, the cover portion 130 can be moved from the closed to the open position by pivoting the cover portion 130 away from the base portion 110, such as, for example and without limitation, by a lifting movement of the cover rim 149 about the dual-compartment container hinge portion 160, as shown by way of example and not limitation in FIG. 7.

In the open position, as illustrated by way of example, and not limitation, in FIGS. 2 and 5B, the cover portion 130 can be moved to substantially 180-degrees relative the base portion 110 about the hinge portion 160. For example, and without limitation, the cover panel 131 of the cover portion 130, defining the top of the cover in the closed position, can be substantially coplanar with the bottom of the base panel 101 of the base portion 110 so as to be disposed on a surface, such as a table or counter, when the base portion is on such a surface. The alignment of the cover portion with the base portion provided by the hinge portion 160 can allow the top of the cover 130 to rest on a food preparing surface, such as a table or counter, to facilitate easy serving of food into the base portion 110 of the dual-compartment container 100 by requiring less handling of the container. Similarly, such a configuration can allow access to the food items contained therein, as well as allow the meal to be served directly from the container. Additionally or alternatively, and as embodied herein, the alignment of the cover portion 130 with the base portion 110 in the open configuration can allow for stacking of multiple open dual-compartment containers prior to use. Such a configuration can facilitate storage and serving and preparation of food items. The tapered walls of each of the cover portion and base portion (130, 110), inclined at respective angles from the cover panel 131 and base panel 101, can also further facilitate the stacking of the dual-compartment food containers prior to use.

According to another aspect of the disclosed subject matter, a unitary blank for forming a dual-compartment container is provided. As embodied herein, the unitary blank of the disclosed subject matter can have dimensions corresponding to the exemplary dimensions of the dual-compartment container, as described herein. The unitary blank includes a base portion having a base panel with opposing first and second base side fold lines and opposing first and second base end fold lines. The base panel has a base panel length between the first and second base end fold lines. A first base end wall extends from the first base end fold line to a first base end edge, and the first base end wall has a first base end wall dimension between the first base end fold line and the first base end edge. A second base end wall extends from the second base end fold line to a second base end edge, and the second base end wall has a second base end wall dimension between the second base end fold line and the second base end edge. The first and second base side walls extend from the first and second base side fold lines, respectively, to a first and second base side edge. The first and second base side walls have a base side wall dimension between the first and second base side fold lines and the first and second base side edges. At least one of the base side edges has an interlocking base tab.

Additionally, the unitary blank of the disclosed subject matter includes a cover panel portion having a cover panel with opposing first and second cover side fold lines and first and second cover end fold lines. The cover panel has a cover panel length between the first and second cover end fold lines. A first cover end wall extends from the first cover end fold line to a first cover end edge, and the first cover end wall has a first cover end wall dimension between the first cover end fold line and the first cover end edge. A second cover end wall extends from the second cover end fold line to a second cover end edge, and the second cover end wall has a second cover end wall dimension between the second cover end fold line and the second cover end edge. The first and second cover side walls extend from the first and second cover side fold lines, respectively, to a cover side edge. The first and second cover side walls have a cover side wall dimension between the first and second cover side fold lines and the first and second cover side edges. At least one of the cover side edges has a an interlocking cover tab substantially aligned and configured to engage a corresponding interlocking base tab.

Referring now to the blank 200 of FIG. 8, the dual-compartment container 100, can be formed from a base portion 210 having a base panel 201, a cover portion 230 having a cover panel 231, and a hinge portion 260 disposed between the base portion and cover portion and integral with both the base panel 201 and cover panel 231. To form the base portion of the dual-compartment container 100 from blank 200, a first base end wall 222 along a first base end fold line 221 is coextensive with the base panel 201. The first base end wall 222 extends a first base end wall dimension from the first base end fold line 221 to an outer end edge and includes a pair of opposing joining flaps (226, 228) extending from opposing outer edge fold lines (225, 227). For purpose of illustration and not limitation, the opposing joining flaps (226, 228) of the first base end wall 222 can be configured to join to first and second base side walls (212, 214) when the first end fold line (221) is folded inward toward the first and second base side walls (212, 214), such as, for example, by adhesive bonding. Additionally or alternatively, slits can be provided in the base side (212, 214) walls to receive projecting flaps (226, 228) therein. As illustrated by way of example in FIG. 8, the opposing joining flaps (226, 228) of the first base end wall 222 can extend from opposing outer edge fold lines (225, 227) at an angle outward from bottom panel 222. Additionally or alternatively, and as embodied herein, the base rim 229 of the first base end wall 222 can have a radiused edge defining an arcuate outer end edge convex relative the base panel 201.

Referring still to FIG. 8, a second base end wall 224 along a second base end fold line 223 is coextensive with the base panel 201. The second base end wall 224 extends a second base end wall dimension from the second base end fold line 223 to a base rim. The second base end wall dimension of the second base end wall 224 is less than the first base end wall dimension of the first base end wall 222. Additionally or alternatively, the second base end wall dimension of the second base end wall 224 can be less than one half of the first base end wall dimension of the first base end wall 222 extending outward from the first base end fold line 221 to the base rim 229. The second base end wall 224 can further include opposing joining tabs (206, 208) extending respectively from opposing outer edge fold lines (205, 207). The opposing joining tabs (206, 208) can be configured to join to the first and second base side walls (212, 214), respectively, such as, for example and without limitation, by suitable adhesive bonding to an inner face when the second end fold line 223 is folded toward the first and second base side walls (212, 214). Additionally or alternatively, slits can be provided in the first and second base side walls (212, 214) to receive projecting tabs (206, 208) therein.

Opposing base side walls (212, 214) are coextensive with the base panel 201 along corresponding first and second base side fold lines (211, 213). Each of the first and second base side walls (212, 214) extend a base side wall dimension from the first and second base side fold lines (211, 213) to the base rim. At least one or both of the base side walls (212, 214) includes an interlocking tab (216, 218). The interlocking tab (216, 218) of the at least one or both of the first and second base side walls (212, 214) can be a raised projection, and can have a curved edge extending to a substantially linear portion of the corresponding first or second base side wall (212, 214).

To form the cover portion 130 of the dual-compartment container 100 herein disclosed, reference still is made to blank 200 depicted in exemplary FIG. 8. A cover panel length is defined between first and second cover end fold lines (243, 241). A first cover end wall 242 extends a first cover end wall dimension from the first cover end fold line 243 to a cover rim 249. Additionally or alternatively, the cover rim 249 of the first cover end wall 242 can have a concave shape relative the cover panel 231. The first cover end wall dimension of the first cover end wall 242 can be substantially equal to the second cover end wall dimension from the second cover end fold line 241 to an outer end edge 261 and the second base end wall dimension combined. The second cover end wall 244 is opposite the second base end wall 224. The cover panel 231 is integral with and outward of the second cover end wall 244 along the second cover end fold line 241 extending to the first cover end fold line 243. Additionally or alternatively, the cover panel length can be less than the base panel length. Opposing first and second cover end fold lines (241, 243) extend between a first and second cover side fold lines (233, 235). As depicted in exemplary FIG. 8, the second cover end wall 244 further includes opposing joining tabs (246, 248) extending from opposing outer edge fold lines (245, 247) of the second cover end wall 244. Additionally, the opposing joining tabs (246, 248) of the second cover end wall 244 can be configured to join to the first and second cover side walls (232, 234), such as, for example and without limitation, by suitable adhesive bonding. Additionally or alternatively, slits can be provided in the first and second cover side walls (232, 234) to receive projecting tabs (246, 248) therein.

With continued reference to FIG. 8, the first and second cover side walls (232, 234) are coextensive with cover panel 231 along respective first and second cover side fold lines (233, 235). Each of the first and second cover side walls (232, 234) extends a cover side wall dimension, respectively, from the first and second cover side fold lines (233, 235) to a cover rim. At least one or both of the cover side walls (232, 234) can include an interlocking cover tab (256, 258). For example and without limitation, the interlocking cover tab (256, 258) can be a projection extending outward relative the first cover end fold line 243 substantially aligned along a length of the container with a corresponding interlocking base tab (216, 218) of the base panel 201. Additionally or alternatively, the projection of the at least one of the interlocking cover tab (256, 258) can have a curved edge. The curved projection of the interlocking cover tab (256, 258) can, for example and without limitation, have a curvature substantially equal to a curvature of a curved projection of the at least one interlocking base tab (216, 218).

Each of the first and second cover side walls (232, 234) further includes a joining tab (252, 254) extending respectively from an outer end fold line (255, 257) proximate the at least one interlocking cover tab (256, 258) of the first and second cover side walls (232, 234). The joining tabs (252, 254) of the first and second cover side walls (232, 234) can be configured to join to the first cover end wall 242, such as, for example and without limitation, by adhesive bonding when the second cover end fold line 243 is folded toward the first and second cover side walls (232, 234). Additionally or alternatively, slits can be provided in the first cover end wall 242 to receive projecting tabs (252, 254) therein.

To form the hinge portion 160 of the dual-compartment container 100, reference again is made to unitary blank 200 depicted in exemplary FIG. 8. As embodied herein, the hinge portion 160 includes first and second outer hinge fold lines (263, 265) each extending to first and second perpendicular score lines (262, 264). The first and second perpendicular score lines (262, 264) are each perpendicular to and extend beyond the outer fold lines (263, 265) and are centrally disposed about the first and second outer hinge fold lines (263, 265). The hinge portion can further include a combination of first and second inner hinge fold lines and score lines parallel with and offset from the first and second outer hinge fold lines. The combination of first and second inner hinge fold lines and score lines extend between the first and second perpendicular score lines. Additionally or alternatively, first and second inner score lines (267, 269) can extend between the first and second inner hinge fold lines, each of the inner score lines being substantially parallel to and spaced from the first and second inner hinge fold lines.

The dual-compartment containers disclosed herein are preferably disposable, but it is contemplated that they can be reused at a future time. Also, the containers can be constructed from materials suitable to be placed in a heating apparatus, such as a microwave, to heat the food and/or used for storage in the refrigerator or freezer. Additionally, the materials from which the food container is made need not be the same throughout. The containers and blanks described herein can be manufactured from any suitable material, including but not limited to pulp board, paperboard, microflute corrugated material, expanded polystyrene foam, oriented polystyrene (OPS), polypropylene, mineral filled polypropylene, amorphous polyethylene terephthalate (APET), thermoplastics, paper, or any other suitable material.

It is to be recognized that the dimensions and relative proportions of the base panel, first and second base side walls, first and second base end walls, cover panel, first and second cover side walls, and first and second cover end walls, joining flaps, joining tabs, etc. of the dual-compartment food container or blank will vary according to the exact size and intended use of the food container or blank. While an essentially rectangular container formed by a blank is herein described, one of ordinary skill in the art will recognize that any suitable shape and depth of the food container and corresponding blank can be employed and the disclosed subject matter is not so limited. Other suitable shapes include triangles, cylinders, ovals, various polygons, etc., having any suitable dimensions.

While the disclosed subject matter is described herein in terms of certain illustrations and examples, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. For example and without limitation, the container can be arranged with the hinge portion disposed between a base side wall and a cover side wall with interlocking base and cover tabs disposed on opposite side walls. Thus, the foregoing description of specific embodiments of the disclosed subject matter has been presented for the purposes of illustration and description. It is not intended to be exhaustive or to limit the disclosed subject matter to those embodiments disclosed.

The description herein merely illustrates the principles of the disclosed subject matter. Various modifications and alterations to the described embodiments will be apparent to those skilled in the art in view of the teachings herein. Accordingly, the disclosure herein is intended to be illustrative, but not limiting, of the scope of the disclosed subject matter.

What is claimed is:

1. A dual-compartment food container comprising:

a base portion having first and second compartment areas defined therein, the base portion comprising:

a base panel defining a bottom of the first and second compartment areas, first and second base end walls each extending from the base panel to a base rim, the first base end wall having a first base end wall dimension between the base panel and the base rim, the second base end wall having a second base end wall dimension between the base panel and base rim, the first base end wall dimension being greater than the second base end wall dimension, and first and second base side walls each extending from the base panel to the base rim and defining opposing base sides of the base portion, at least one of the first and second base side walls including an interlocking base tab;

a cover portion hingedly movable relative the base portion between an open position and a closed position, wherein, in the closed position, the cover portion is disposed over the first compartment area of the base portion with the second compartment area of the base portion extending beyond the cover portion, the cover portion comprising:

a cover panel defining a top of the cover portion, first and second cover end walls each extending from the cover panel to a cover rim, the first cover end wall having a first cover end wall dimension between the cover panel and the cover rim, the second cover end wall having a second cover end wall dimension between the cover panel and cover rim, the first cover end wall dimension being greater than the second cover end wall dimension, and first and second cover side walls each extending from the cover panel to the cover rim and defining opposing cover sides of the cover portion, at least one of the first and second cover side walls including an interlocking cover tab configured to engage the at least one corresponding interlocking base tab when the cover portion is in the closed position; and a hinge portion disposed between the base portion and cover portion, the hinge portion comprising:

first and second outer hinge fold lines each extending to a first and a second perpendicular score line, respectively, and first and second inner hinge fold lines parallel with and offset from the first and second outer hinge fold lines, the first and second inner hinge fold lines extending between the first and second perpendicular score lines.

2. The dual-compartment food container of claim 1, wherein the first and second base side walls each have a base side wall dimension between the base panel and the base rim, and the base side wall dimension is less than the first base end wall dimension.

3. The dual-compartment food container of claim 1, wherein the first base end wall extends from the base panel to a radiused outer end edge of the base rim.

4. The dual-compartment food container of claim 1, wherein the first base end wall further comprises opposing joining flaps extending outwardly from opposing outer edges of the first base end wall, each of the opposing joining flaps configured to join to the first and second base side walls.

5. The dual-compartment food container of claim 1, wherein the interlocking base tab has a curved projection extending to a substantially linear edge portion of the at least one of the first or second base side wall.

6. The dual-compartment food container of claim 1, wherein the second base end wall further comprises opposing joining tabs extending from opposing outer edges of the second base end wall, the opposing joining tabs configured to join to the first and second base side walls.

7. The dual-compartment food container of claim 1, wherein the hinge portion further comprises a pair of inner score lines extending between the first and second inner hinge fold lines, each of the inner score lines being substantially collinear with the first and second inner hinge fold lines.

8. The dual-compartment food container of claim 1, wherein the first and second perpendicular score lines extend beyond the first and second outer hinge fold lines.

9. The dual-compartment food container of claim 1, wherein the first and second cover side walls each have a cover side wall dimension between the cover panel and the cover rim.

10. The dual-compartment food container of claim 9, wherein the cover side wall dimension is less than the first cover end wall dimension.

11. The dual-compartment food container of claim 1, wherein the first cover end wall extends from the cover panel to the cover rim having a concave shape relative the cover panel.

12. The dual-compartment food container of claim 1, wherein the cover side wall dimension is greater than the base side wall dimension.

13. The dual-compartment food container of claim 1, wherein the interlocking cover tab has a curved projection having a curvature substantially equal to a curvature of a curved projection of the interlocking base tab.

14. The dual-compartment food container of claim 1, wherein the first cover end wall dimension is greater than the second cover end wall, the first cover end wall configured to separate the first and second compartment areas of the base portion when the cover portion is in the closed position.

15. The dual-compartment food container of claim 1, wherein the first and second cover side walls each further comprise a joining tab extending therefrom and configured to join to the cover end wall.

16. A unitary blank for forming a dual-compartment food container comprising:

a base portion comprising:

a base panel having opposing first and second base side fold lines and opposing first and second base end fold lines, the base panel having a base panel length between the first and second base end fold lines, a first base end wall extending from the first base end fold line to a first base end edge, the first base end wall having a first base end wall dimension between the first base end fold line and the first base end edge, a second base end wall extending from the second base end fold line to a second base end edge, the second base end wall having a second base end wall dimension between the second base end fold line and the second base end edge, first and second base side walls extending from the first and second base side fold lines, respectively, to a first and second base side edge, the first and second base side walls having a base side wall dimension between the first and second base side fold lines and the first and second base side edge, at least one of the base side edges having an interlocking base tab;

a cover panel portion comprising:

a cover panel having opposing first and second cover side fold lines and first and second cover end fold lines, the cover panel having a cover panel length between the first and second cover end fold lines, a first cover end wall extending from the first cover end fold line to a first cover end edge, the first cover end wall having a first cover end wall dimension between the first cover end fold line and the first cover end edge, a second cover end wall extending from the second cover end fold line to a second cover end edge, the second cover end wall having a second cover end wall dimension between the second cover end fold line and the second cover end edge, first and second cover side walls extending from the first and second cover side fold lines, respectively, to a cover side edge, the first and second cover side walls having a cover side wall dimension between the first and second cover side fold lines and the first and second cover side edge, at least one of the cover side edges having an interlocking cover tab substantially aligned and configured to engage a corresponding interlocking base tab; and a hinge portion disposed between the base portion and the cover portion, the hinge portion comprising:

first and second outer hinge fold lines each extending to a first and a second perpendicular score line, respectively, and first and second inner hinge fold lines parallel with and offset from the first and second outer hinge fold lines, the first and second inner hinge fold lines extending between the first and second perpendicular score lines.

17. The unitary blank of claim 16, wherein the base side wall dimension is less than the first base end wall dimension.

18. The dual-compartment food container of claim 16, wherein the first base end wall extends from the base panel to the base rim having a radiused outer end edge.

19. The unitary blank of claim 16, wherein the first base end wall dimension is greater than the second base end wall dimension.

20. The unitary blank of claim 16, wherein the first base end wall further comprises opposing joining flaps extending outwardly from opposing outer base edge fold lines of the first base end wall, the opposing joining flaps configured to join to the first and second base side walls, respectively, when the first base end wall is folded about the first base end fold line.

21. The unitary blank of claim 16, wherein the at least one interlocking base tab has a curved projection extending to a substantially linear edge portion of the at least one of the first or second base side wall.

22. The unitary blank of claim 16, wherein the second base end wall further comprises opposing joining tabs extending from opposing outer base edge fold lines of the second base end wall, the opposing joining tabs configured to join to the first and second base side walls, respectively, when the second base end wall is folded about the second base end fold line.

23. The unitary blank of claim 16, wherein the first cover end wall dimension is approximately equal to the second base end wall dimension.

24. The unitary blank of claim 16, wherein the cover top panel length is less than the bottom panel length.

25. The unitary blank of claim 16, wherein the first cover end wall further comprises opposing cover joining tabs extending outwardly from opposing outer cover edge fold lines of the first cover end wall, the cover joining tabs configured to join to the first and second cover side walls, respectively, when the first cover end wall is folded about the first cover end fold line.

26. The unitary blank of claim 16, wherein the at least one interlocking cover tab has a curved projection having a curvature substantially equal to a curvature of a curved projection of the interlocking base tab.

27. The unitary blank of claim 16, wherein the first and second cover side walls each further comprise a joining tab extending from an outer end fold line, the joining tab configured to join to the second cover end wall when the second cover end wall is folded about the second cover end fold line.

28. The unitary blank of claim 16, wherein the first cover end wall has a greatest dimension substantially equal to the second cover end wall dimension and the second base end wall dimension combined.

29. The unitary blank of claim 16, wherein the first cover end edge has a concave shape relative the cover panel.

30. The unitary blank of claim 16, wherein the hinge portion further comprises a pair of inner score lines extending between the first and second inner hinge fold lines, each of the inner score lines being substantially collinear with the first and second inner hinge fold lines.

31. The unitary blank of claim 16, wherein the first and second perpendicular score lines extend beyond the first and second outer hinge fold lines.

* * * * *